United States Patent [19]

Hayase et al.

[11] Patent Number: 4,608,002

[45] Date of Patent: Aug. 26, 1986

[54] ROTARY VANE COMPRESSOR WITH HOOK-LIKE SUCTION PASSAGE

[75] Inventors: Isao Hayase; Atsuo Kishi, both of Katsuta, Japan

[73] Assignee: Hitachi, Ltd., Tokyo, Japan

[21] Appl. No.: 464,944

[22] Filed: Feb. 8, 1983

[30] Foreign Application Priority Data

Feb. 8, 1982 [JP] Japan ..... 57-17520

[51] Int. Cl.[4] ..... F04C 18/00

[52] U.S. Cl. ..... 418/86; 418/270

[58] Field of Search ..... 418/86, 61 A, 259–270

[56] References Cited

U.S. PATENT DOCUMENTS 2,380,783 7/1945 Painter ..... 418/133

3,790,314 2/1974 Swain ..... 418/268

FOREIGN PATENT DOCUMENTS 3017045 11/1980 Fed. Rep. of Germany ..... 418/270

*Primary Examiner*—Leonard E. Smith

*Assistant Examiner*—Jane L. Obee

*Attorney, Agent, or Firm*—Antonelli, Terry & Wands

[57] ABSTRACT

A movable vane type compressor having a rotor rotatable within a cam cylinder. The inner peripheral surface of the cam cylinder and the outer peripheral surface of the rotor approach each other most closely at a plurality of positions which in combination define a plurality of compression chambers between these peripheral surfaces. The rotor carries a plurality of movable vanes which are movable radially inwardly and outwardly with their one ends held in sliding contact with the inner peripheral surface of the cam cylinder as the rotor rotates so as to cause suction, compression and discharge actions in each compression chamber. A refrigerant passage for introducing the refrigerant gas into the compression chambers is formed between the side plate closing one axial end of the cam cylinder and a front cover covering the side plate. The suction passage extends in a hook-like form in the direction of rotation of the rotor.

4 Claims, 7 Drawing Figures

ROTARY VANE COMPRESSOR WITH HOOK-LIKE SUCTION PASSAGE

BACKGROUND OF THE INVENTION

The present invention relates to a compressor of movable vane type and, more particularly, to a movable vane type compressor having at least two tangential sealing portions formed between the inner peripheral surface of a cylinder and the outer peripheral surface of a rotor.

In, for example, Japanese Patent Publication No. 36433/1982 corresponding to German Patent No. P2223087.1, a movable vane type compressor is proposed having a rotor, a casing surrounding the rotor and axial end plates which close both axial ends of the cylinder. A plurality of compression chambers are defined in the space between the outer peripheral surface of the rotor and the inner peripheral surface of the casing by a plurality of tangential sealing portions. The rotor has a plurality of vane grooves each movably receiving a vane which makes a sliding contact with the inner peripheral surface of the casing. As the rotor rotates, the movable vanes move in the vane grooves inwardly and outwardly while sliding along the inner peripheral surface of the casing. Each compression chamber completes one cycle of operation consisting of suction stroke, compression stroke and discharging stroke, as the vanes pass the chamber. A refrigerant is introduced from a refrigeration cycle into the compressor through a substantially bowl-shaped side cover formed on one side surface of the cylinder.

The refrigerant introduced into the side cover is drawn into the compression chambers through suction ports which provide communication between the compression chambers and a refrigerant passage in the side cover in timed relationship to the suction stroke of each compression chamber. In the conventional movable vane type compressor, the refrigerant introduced through a suction port into the refrigerant passage in the side cover is once retarded and then drawn into the compression chambers by the suction force transmitted through the suction ports.

Consequently, a large suction resistance is imposed on the flow of refrigerant flowing into the compression chambers, which, in turn, makes it difficult to improve the volumetric efficiency and the overall adiabatic efficiency.

Accordingly, an object of the invention is to provide a movable vane type compressor which eliminates substantial retardation of the refrigerant introduced into the refrigerant passage through the suction port thereby reducing the suction resistance encountered by the flow of refrigerant flowing into the suction ports.

Another object of the invention is to provide a movable vane type compressor in which the flow velocities of refrigerant directed to all suction ports are equalized to avoid substantial variation of the suction rate according to the difference in position of the work chambers thereby attaining a higher efficiency of the compressor.

Still another object of the invention is to provide a movable vane type compressor in which a drastic change of flowing direction of the refrigerant at the inlet of each suction port is avoided to further decrease the suction resistance.

To this end, according to one aspect of the invention, there is provided a movable vane type in which a refrigerant passage is formed in a hook-like form extending from a suction hole as a starting point to the other end which is substantially closed, and suction ports of compression chambers communicate with the refrigerant passage at a predetermined distance from one another along the length of the passage.

In accordance with another aspect of the invention, there is provided a movable vane type compressor of the kind described, in which the cross-sectional area of a hook-like refrigerant passage is gradually decreased at each juncture of suction ports.

In accordance with still another aspect of the invention, there is provided a movable vane type compressor of the kind described, in which a refrigerant passage is formed in a hook-like form extending in the rotational direction of a rotor.

In accordance with additional advantageous features of the present invention, a portion of the suction passage contacting each suction port has a curved surface curved in conformity with a direction of flow of the refrigerant.

Advantageously, in accordance with the present invention, a portion of each of the suction ports leading from the suction passage to the compression chamber have a wall constituted by a curved surface conforming with a direction of flow of the refrigerant.

Other objects, features and advantages of the invention will become clear from the following description of the preferred embodiments taken in conjunction with the accompanying drawings.

DETAILED DESCRIPTION

A movable vane type compressor in accordance with a preferred embodiment of the invention will be described hereinunder with reference to the accompanying drawings.

Figure 1:
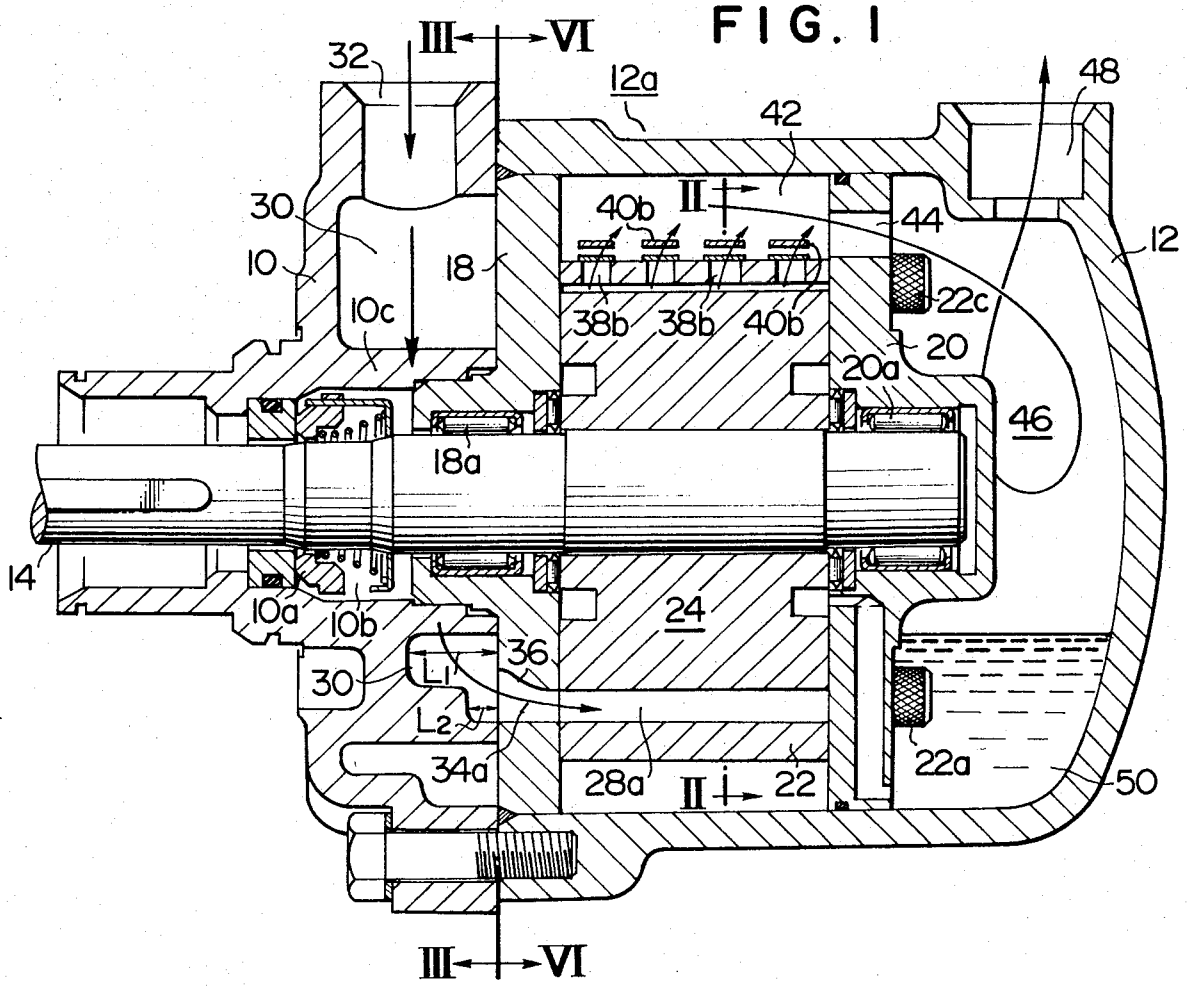
FIG. 1 is a sectional side elevational view of a movable vane type compressor in accordance with an embodiment of the invention.
Figure 2:
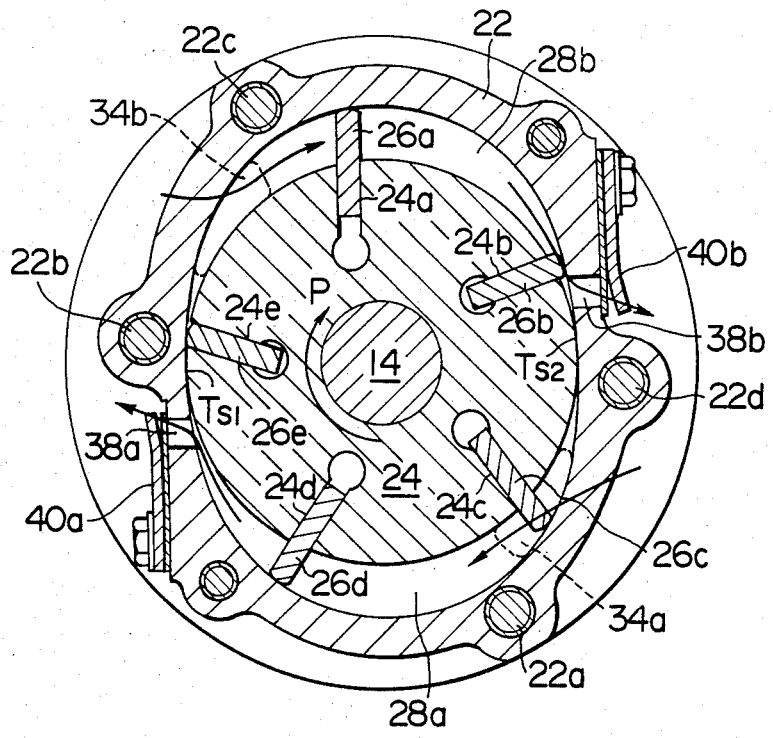
FIG. 2 is a sectional view taken along the line II—II of FIG. 1.

Referring first to FIGS. 1 and 2, a closed chamber 12*a* is formed by a front cover 10 and a substantially bowl-shaped casing 12. A shaft 14 is extended through the center of the closed chamber 12*a*. The shaft 14 has one end projected out of the front cover 10, with a projected end of the shaft 14 carrying the driven member of an electromagnetic clutch (not shown) attached to one side of the front cover 10 so that the shaft 14 is driven by the power transmitted from an engine through the electromagnetic clutch. The shaft 14 is extended into the chamber 12*a* through a shaft seal 10*a*provided on the front cover 10 and is rotatably supported by bearings 18*a*, 20*a* on side plates 18, 20 which are mounted in the chamber 12*a* at a predetermined distance from each other. A cylindrical cam cylinder 22 is fixed and clamped by bolts 22*a* to 22*c* between the pair of side plates 18, 20 mounted in the chamber 12*a* at a predetermined distance from each other. A rotor 24, carried by the shaft 14, is rotatably housed by the cam cylinder 22. The rotor 24 has a cylindrical body of a circular cross-section and is provided with a plurality of radial vane grooves 24*a* to 24*e* which respectively radially movably receive vanes 26*a* to 26*e*.

The cam cylinder 22 has an inner peripheral surface of a cross-sectional shape constituted by a curve approximating a epitrocoidal curve so that the inner peripheral surface of the cam cylinder 22 and the outer peripheral surface of the rotor 24 approach each other most closely at two points $Ts_1$, $Ts_2$, as shown most clearly in FIG. 2, so as to define two compression chambers 28*a*, 28*b* in the space between the outer peripheral surface of the rotor 24 and the inner peripheral surface of the cylinder 22. The compression chambers 28*a*, 28*b* are closed at both axial ends by the pair of side plates 18 and 20.

Figure 3:
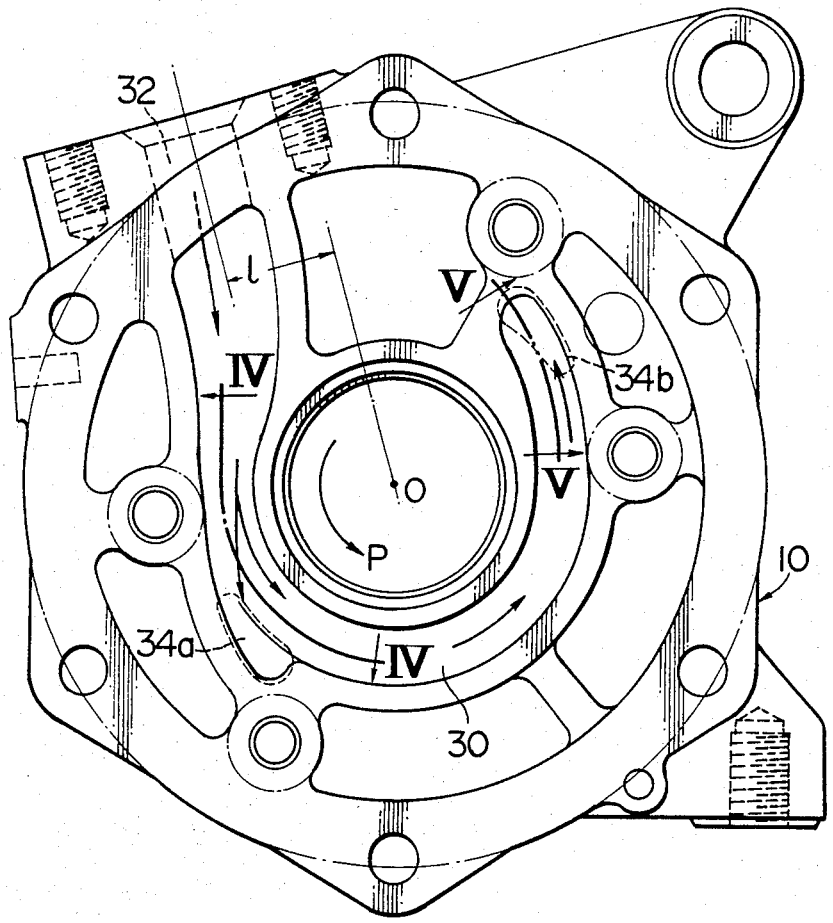
FIG. 3 is a sectional view taken along the line III—III of FIG. 1.

A suction passage 30 is formed between the front cover 10 and the side plate 18 adjacent to the front cover 10. As shown in FIG. 3, the suction passage 30 includes a recess formed in a hook-like form in the inner surface of the front cover 10 around a shaft seal chamber 10*b* which is also formed in the front cover 10. More specifically, the suction passage 30 has a gas inlet side in communication with a gas suction port 32 formed in the outer surface of the front cover 10 and extending in a direction tangential to the wall 10*c* of the shaft seal chamber 10*b*to extend around over a half of the circumference of the shaft seal chamber 10*b*. The end of the suction passage 30 is blocked at a position opposing to the final suction port 34*b*. Thus, the suction passage 30 generally has a hook-like form. The suction passage 30 is in communication with suction ports 34*a*, 34*b* formed in the side plate 18 and communicating with the respective compression chambers 28*a*, 28*b*. The suction ports 34*a*, 34*b* directly open to the compression chambers 28*a*, 28*b* through the thickness of the side plate 18. In the illustrated embodiment, two suction ports 34*a*, 34*b* are formed so as to respectively correspond to two compression chambers 28*a*, 28*b*. Therefore, one of the suction ports 34*b* faces the terminal end of the suction passage 30 while the other suction port 34*a* is opposed to an intermediate portion of the suction passage 30, and the suction passage 30 is communicated with respective compression chambers 28*a*, 28*b* through the suction ports 34*a*, 34*b*. The hook-like form of the suction passage 30 is designed such that the direction of flow of the refrigerent from the inlet side communicating with the suction port 32 towards the terminal end of the passage 30 coincides with the direction P of rotation of the rotor 24.

The suction port 32 for the refrigerant gas is located at such a position that the center thereof is offset from the axis O of rotation of the rotor by a distance l, so that the refrigerant gas, introduced through the suction port 32, can flow into and along the spiral suction passage 30 without any abrupt or drastic change of the flowing direction. The distance l of the offset is preferably determined such that the inlet side of the suction passage 30 extends tangentially to the wall of the shaft seal chamber 10*b*. The suction passage 30 extends along a portion of a cirlce scribed at a predetermined radius from the axis of rotation O as shown in FIG. 3.

The cross-sectional area of the inlet portion of the hook-like suction passage 30 leading from the suction port 32 is gradually decreased so as to eliminate any loss of energy of the gas which may be caused by a drastic increase of the cross-sectional area of the passage when the gas is introduced through the suction hole 32.

Figure 4:
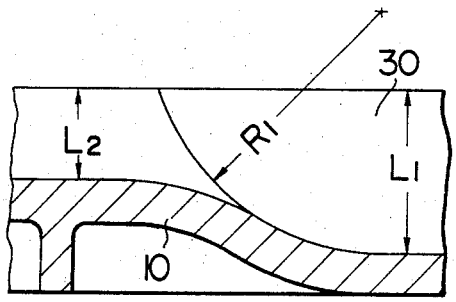
FIG. 4 is a sectional view taken along the line IV—IV of FIG. 3.
Figure 5:
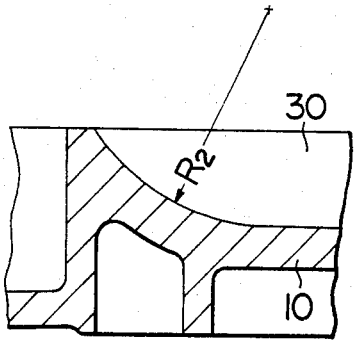
FIG. 5 is a sectional view taken along the line V—V of FIG. 3.

As shown in FIGS. 4 and 5, the bottom portions of the hook-like suction passage 30 facing the suction ports 34*a*, 34*b* protrude at predetermined radii of curvature $R_1$, $R_2$. Therefore, when the refrigerant gas swirling in a plane perpendicular to the axis of rotation of the rotor is introduced into respective compression chambers through the suction ports 34*a*, 34*b* formed in the side plate 18, it is possible to smoothly and gently change the direction of flow of the refrigerant gas. In the described embodiment of the invention, two suction ports 34*a*, 34*b* are formed in the side plate 18 in communication with the hook-like suction passage 30, so that almost a half of the refrigerant gas is drawn by the compresssion chamber 28*a* through the suction port 34*a* opening to the intermediate portion of the spiral refrigerant passage 30, and the flow rate of the refrigerant gas in the portion of the passage 30 downstream from the suction port 34*a* is reduced to a half. The abrupt reduction in the flow rate causes a drastic reduction in the flowing velocity which, in turn, incurs a large loss of energy possessed by the fluid. This problem, however, is suppressed in the described embodiment by virtue of the fact that the height of the bottom of the refrigerant passage 30 is increased to decrease the height of the passage from $L_1$ to $L_2$ across the first suction port 34*a* so as to avoid abrupt change of the flowing velocity in spite of the change in the flow rate. Namely, the cross-sectional area of the refrigerant passage 30 is decreased in a stepped manner along the length of a passage, at each of the suction ports 34 arranged along the length of the passage 30 from the upstream end towards the downstream end of the passage 30. The number of steps of change in the cross-sectional area of the suction passage 30 is determined in accordance with the number of the compression chambers 28*a*, 28*b* and the suction ports 34*a*, 34*b* which, in turn, are determined in conformity with the number of lobes of the inner peripheral surface of the cam cylinder 22.

Figure 6:
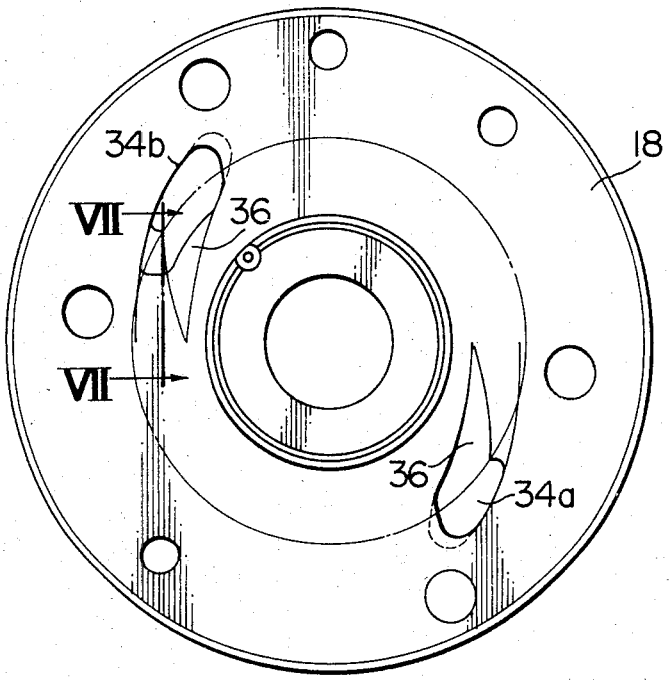
FIG. 6 is a sectional view taken along the line VI—VI of FIG. 1.
Figure 7:
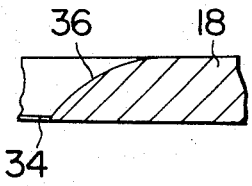
FIG. 7 is a sectional view taken along the line VII—VII of FIG. 6.

As will be seen from FIG. 6, the suction ports 34*a*, 34*b*, communicating with the compression chambers 28*a*, 28*b*, are formed to continue to inclined grooves 36 formed in the side plate 18 and extend substantially in the direction of rotation of the rotor. The inclined grooves 36 correspond to the suction passage 30 formed in the surface of the front cover 10, and the bottom of each groove 36 is gently curved from the upstream side to the downstream side, as viewed in the direction of the swirling flow of the gas, as apparent from FIG. 7. The groove 36 is continuous with the protruded bottom of the suction passage 30 formed in the surface of the front cover so that the flow resistance encountered by the refrigerant gas when the latter changes the flow direction from the rotational direction to the axial direction is advantageously decreased.

The refrigerant gas introduced into the compression chambers 28*a*, 28*b* through the suction passage 30 then through the suction ports 34*a* and 34*b* is discharged through a plurality of small ports constituting discharge ports 38*a*, 38*b* formed in the cam cylinder 22. The discharge ports 38*a*, 38*b* are in communication with a discharge passage 42 formed between the casing 12 and the cam cylinder 22, through discharge valves 40*a* and 40*b* provided on the outer surface of the cam cylinder 22. The discharge passage 42 leads to a chamber 46 provided at the rear part of the compressor through a discharge opening 44 formed in the side plate 20 more remote from the front cover 10. The gas is then discharged from the chamber 46 through a discharge hole 48 formed in the top of the chamber 46. When the compressed gas flows through the discharge passage 42 and the discharge opening 44, oil 50 is separated from the gas by means of an oil separator (not shown). Therefore, the gas is discharged from the discharge hole 48 after sufficient separation of oil therefrom.

In the movable vane type compressor of the type described above, the suction resistance encountered by the refrigerant gas flowing from the suction port 32 to the compression chambers 28*a*, 28*b* is remarkably decreased. Namely, since the size of the inlet portion of the hook-like suction passage 30, leading from the suction hole 32, is selected to eliminate any abrupt increase of the cross-sectional area of the passage, the loss of energy possessed by the gas attributable to an abrupt increase of the cross-sectional area of the passage is sufficiently reduced, as compared with the conventional compressor in which the suction hole is connected directly to the inlet portion of the passage 30 of an ample volume. Since the suction passage 30 extends in an hook-like form in the same direction as the rotation of the rotor 24, the refrigerant introduced into the suction passage 30 forms a swirling flow following up the rotation of the rotor and is smoothly drawn into the suction chambers 28*a*, 28without substantially changing the flow direction, through the suction ports 34*a*, 34*b* in the side plate 18. In addition, the refrigerant gas is allowed to flow from the suction passage 30 into the compression chambers 28*a*, 28*b* with a substantial axial flow components and without abrupt change of the flow direction, partly because the bottom portions of the suction passage 30 facing the suction ports 34*a*, 34*b* are protruded towards the side plate 18 and partly because inclined grooves 36 are formed in the side plate 18 continuously with the suction ports 34*a*, 34*b*. Furthermore, since the cross-sectional area of the passage 30 is changed in a stepped manner at every position of the suction ports 34, the undesirable abrupt change in the flow velocity is avoided even though the flow rate of the refrigerant gas is changed in a stepped manner along the length of the suction passage 30 due to the presence of a plurality of suction ports. It is to be noted also that, in the compressor of the invention, the pulsation of the suction pressure is remarkably suppressed due to the combination of the cam cylinder 22 having an oval cross-section and the five vanes 26*a* to 26*e*, so that a substantially steady flow of refrigerant is obtained at the suction side of the compressor to multiply the effect of reduction in the suction resistance.

As will be understood from the foregoing description, in the compressor of the invention, the suction resistance is remarkably decreased due to a reasonable aerodynamic arrangement in which the suction passage 30 extends in a hook-like form in the direction conforming with the direction of rotation of the rotor. It is, therefore, possible to introduce the gas into the compression chambers 28*a*, 28*b* solely through the suction ports 34*a*, 34*b* formed in the side plate 18 and yet the 4% to 5% increase of the suction efficiency is attained. The increase in the suction efficiency improves the performance of the compressor and eliminates a rise of the discharge temperature. Furthermore, unlike the conventional compressor in which the suction ports are formed in the peripheral wall of the cam cylinder 22, it is possible to sufficiently reduce the wall thickness of the cam cylinder 22 which, in turn, contributes to a reduction in size and weight of the compressor as a whole. The suction passage 30, which has only to have a hook-like form communicating with the suction ports formed in the side plate 18, can be formed quite easily.

It will be also understood that the invention can be applied to a movable vane type compressor having more than two compression chambers, although the compressor of the described embodiment has only two compression chambers.

As has been described, in the movable vane type compressor of the invention, the aerodynamic resistance encountered by the gas flowing along the suction passage is remarkably decreased due to the hook-like form of the suction passage. This in turn permits a substantial reduction of the compression ratio, while offering improvement in the volumetric efficiency and overall adiabatic efficiency, as well as a lowering of the discharge temperature. Consequently, according to the invention, it is possible to reduce the theoretical volume of the compressor and, accordingly, and advantageously reduce the size and weight of the compressor.

What is claimed is:

1. A movable vane type compressor comprising.

a cylindrical rotor adapted to be rotatably driven;

a cam cylinder accommodating said rotor and having an inner peripheral surface material contacting the outer peripheral surface of said rotor at a plurality of portons thereof;

a pair of side plates closing both open axial ends of said cam cylinder;

a plurality of compression chambers separated from adjacent ones by said portions of contact between the outer peripheral surface of said rotor and the inner peripheral surface of said cam cylinder and defined by said outer peripheral surface of said rotor, the inner peripheral surface of said cam cylinder and the pair of side plates;

a plurality of vanes radially movably mounted on said rotor and rotatable together with said rotor, with their outer ends held in sliding contact with said inner peripheral surface of said cam cylinder;

a side cover attached to one side of one of said side plates;

a suction passage formed in the surface of said side cover and adapted to introduce a refrigerant gas into said compression chambers; and a plurality of suction ports each opened at one end thereof to said suction passage and opened at the other end thereof to a compression chamber;

wherein the improvement comprises that said suction passage extends in a hook-like form from one inlet end leading from the refrigerant suction hole of said compressor to the other end which is closed in a direction conforming with the direction of rotation of said rotor, and wherein the hook-like suction passage is formed to gradually decrease the cross-sectional area thereof from the inlet end towards the closed end thereof.

2. A movable vane type compressor a cylindrical rotor adapted to be rotatably driven;

a cam cylinder accommodating said rotor and having an inner peripheral surface material contacting the outer peripheral surface of said rotor at a plurality of portons thereof;

a pair of side plates closing both open axial ends of said cam cylinder;

a plurality of compression chambers separated from adjacent ones by said portions of contact between the outer peripheral surface of said rotor and the inner peripheral surface of said cam cylinder and defined by said outer peripheral surface of said rotor, the inner peripheral surface of said cam cylinder and the pair of side plates;

a plurality of vanes radially movably mounted on said rotor and rotatable together with said rotor, with their outer ends held in sliding contact with said inner peripheral surface of said cam cylinder;

a side cover attached to one side of one of said side plates;

a suction passage formed in the surface of said side cover and adapted to introduce a refrigerant gas into said compression chambers; and a plurality of suction ports each opened at one end thereof to said suction passage and opened at the other end thereof to a compression chamber;

wherein the improvement comprises that said suction passage extends in a hook-like form from one inlet end leading from the refrigerant suction hole of said compressor to the other end which is closed in a direction conforming with the direction of rotation of said rotor, and wherein the cross-sectional area of said hook-like suction passage is decreased in a stepped manner towards the closed end of said suction passage at the positions corresponding to said suction ports.

3. A movable vane type compressor according to claim 2, wherein said suction ports communicating with said spiral suction passage are formed in one of said side plates.

4. A movable vane type compressor according to claim 3, wherein the portion of each of said suction ports leading from said suction passage to said compression chamber has a wall constituted by a curved surface conforming with the direction of flow of said refrigerant.

* * * * *